United States Patent [19]

Miles et al.

[11] Patent Number: 4,919,791

[45] Date of Patent: Apr. 24, 1990

[54] CONTROLLED OPERATION OF HIGH CURRENT DENSITY OXYGEN CONSUMING CATHODE CELLS TO PREVENT HYDROGEN FORMATION

[75] Inventors: Ronald C. Miles; David D. Justice; Kenneth E. Woodard, Jr., all of Cleveland, Tenn.

[73] Assignee: Olin Corporation, Cheshire, Conn.

[21] Appl. No.: 785,686

[22] Filed: Oct. 9, 1985

Related U.S. Application Data

[63] Continuation-in-part of Ser. No. 727,171, Apr. 25, 1985, Pat. No. 4,578,159.

[51] Int. Cl.[5] ..... C25B 1/16; C25B 1/26

[52] U.S. Cl. ..... 204/98; 204/128

[58] Field of Search ..... 204/98, 128, 228, 252, 204/283, 290 R

[56] References Cited

U.S. PATENT DOCUMENTS

| | | | |
|---|---|---|---|
| 4,035,254 | 7/1977 | Gritzner | 204/98 |
| 4,191,618 | 3/1980 | Coker et al. | 204/98 |
| 4,212,721 | 7/1980 | Bergner et al. | 204/228 |
| 4,213,833 | 7/1980 | Lefevre | 204/296 |
| 4,221,644 | 9/1980 | LaBarre | 204/98 |
| 4,224,129 | 9/1980 | McIntyre et al. | 204/263 |
| 4,244,793 | 1/1981 | Johnson et al. | 204/98 |
| 4,312,720 | 1/1982 | Lefevre | 204/78 |
| 4,332,662 | 6/1982 | Pouli et al. | 204/265 |
| 4,341,606 | 7/1982 | McIntyre et al. | 204/98 |
| 4,364,805 | 12/1982 | Rogers | 204/98 |
| 4,376,691 | 3/1983 | Lindstrom | 204/265 |
| 4,377,455 | 3/1983 | Kadija et al. | 204/283 |
| 4,379,034 | 4/1983 | Rogers | 204/98 |
| 4,406,758 | 9/1983 | McIntyre et al. | 204/98 |
| 4,417,959 | 11/1983 | Kadija et al. | 204/283 |
| 4,430,177 | 2/1984 | McIntyre et al. | 204/98 |
| 4,445,986 | 5/1984 | McIntyre et al. | 204/283 |
| 4,486,276 | 12/1984 | Cohn et al. | 204/98 |
| 4,488,947 | 12/1984 | Miles | 204/98 |
| 4,511,441 | 4/1985 | McIntyre et al. | 204/98 |
| 4,532,018 | 7/1985 | Wright et al. | 204/98 |

*Primary Examiner*—John F. Niebling
*Assistant Examiner*—Kathryn Gorgos
*Attorney, Agent, or Firm*—James B. Haglind; Paul Weinstein

[57] ABSTRACT

A process for the electrolysis of an alkali metal halide brine is operated in an electrolytic cell having an anode compartment containing at least one anode, a cathode compartment containing at least one cathode, and a cation exchange membrane separating the anode compartment from the cathode compartment. The process comprises:

(a) feeding the alkali metal halide brine to the anode compartment;

(b) electrolyzing the alkali metal halide brine at a current density of at least about 2 kiloamperes per square meter to produce a halogen gas and alkali metal ions in the anode compartment;

(c) passing the alkali metal ions and water through the cation exchange membrane into the cathode compartment wherein contact is maintained between the cation exchange membrane and the hydrophilic porous cathode;

(d) feeding an oxygen-containing gas to the cathode compartment;

(e) producing a concentrated alkali metal hydroxide solution while limiting the formation of hydrogen; and (f) removing the concentrated alkali metal hydroxide solution from the cathode compartment to prevent an accumulation of concentrated alkali metal hydroxide in the cathode compartment.

Operation of the process of the present invention is free of the restrictions for hydrostatic pressures and gas pressures required when hydrophobic cathode materials are used in the cathode compartment. The process further permits the use of increased current densities without forming significant amounts of hydrogen gas.

18 Claims, 1 Drawing Sheet

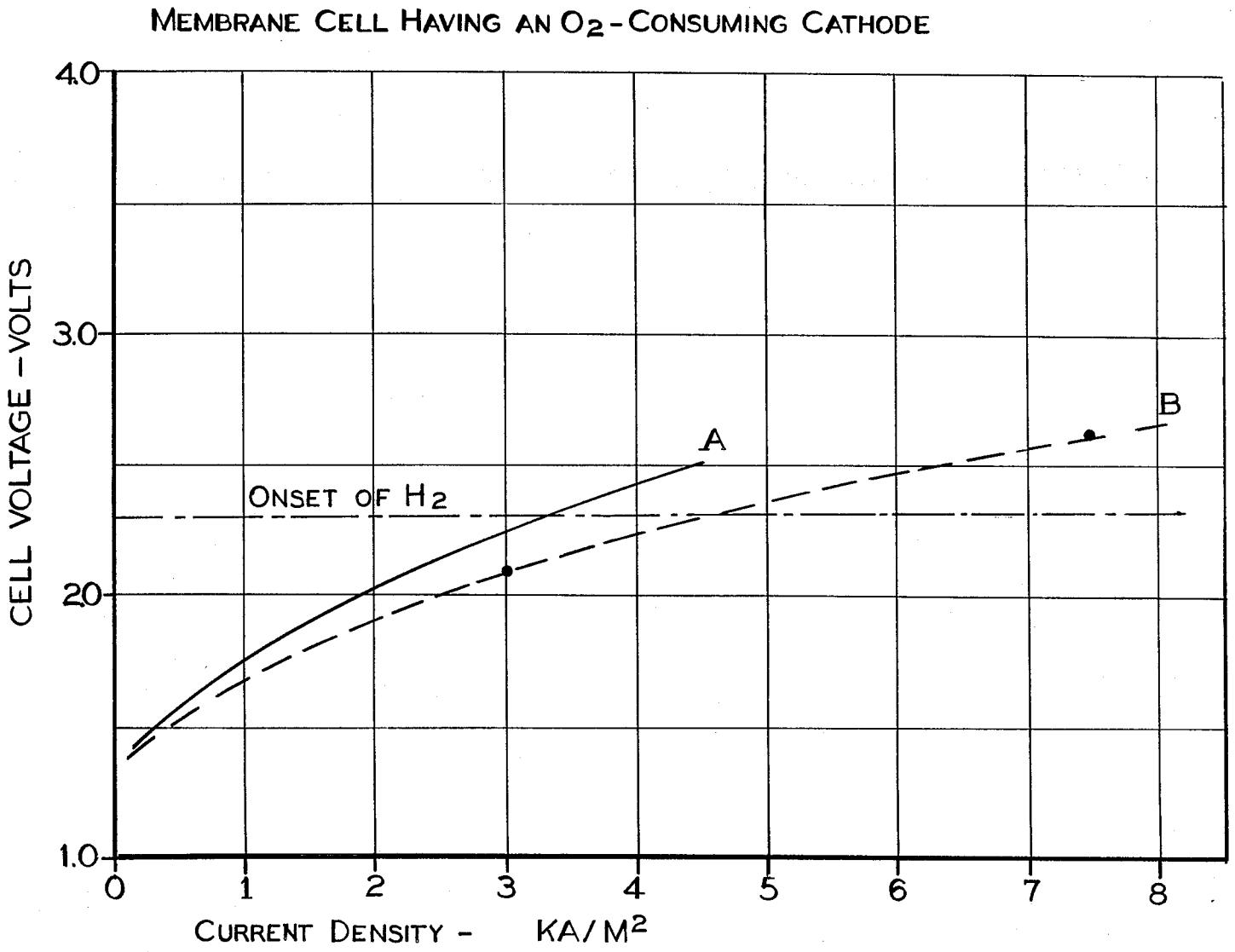
MEMBRANE CELL HAVING AN O2-CONSUMING CATHODE
CELL VOLTAGE -VOLTS
4.0
3.0
2.0
1.0
0
1
2
3
4
5
6
7
8
CURRENT DENSITY - KA/M2
ONSET OF H2
A
B

CONTROLLED OPERATION OF HIGH CURRENT DENSITY OXYGEN CONSUMING CATHODE CELLS TO PREVENT HYDROGEN FORMATION

This is a continuation-in-part application of U.S. application Ser. No. 727,171, filed Apr. 25, 1985, now U.S. Pat. No. 4,578,159.

This invention relates to electrolytic cells for the production of chlorine and alkali metal hydroxides. More specifically, the invention relates to electrolytic cells for the production of chlorine and alkali metal hydroxides employing an oxygen-containing gas in the cathode compartment.

The commercial production of chlorine and alkali metal hydroxides is normally carried out at industrial plants employing electrolytic cells in size and number sufficient to produce large volumes of products. The chlorine gas produced is converted to liquid chlorine by procedures employing purification, compression and cooling of $Cl_2$. Liquid chlorine is then stored and shipped to customers who often convert it back to gas form before use. Hydrogen gas is produced at these commercial plants in sufficient amounts so that it can be sold or burned as a fuel.

More recently, however, users of chlorine have desired electrolytic cells at their plant sites which can produce chloride gas in limited amounts for direct use without the need for liquefaction and its accompanying expenses and avoiding the necessity of storing large amounts of chlorine with the hazards and expenses involved. Further, the co-production of hydrogen gas and its subsequent disposal is not desired. Thus, there is a need for commercial size electrolytic cells for the efficient production of chlorine in the absence of hydrogen as a co-product.

In theory, the use of oxygen consuming cathodes in place of hydrogen cathodes in chlor/alkali electrolysis should satisfy this need while significantly reducing the energy consumption required. For example, Schmid and Medic point out in "Investigation of Oxygen-Consuming Cathodes for Use in Chlor/Alkali Electrolysis", Dechema Monograph, 92, 1982, pp. 335–347, that fundamentally the oxygen consuming cathode could save up to a maximum of 1.23 volts vs. the hydrogen evolving cathode. Fundamental and practical problems have, however, until now, prevented the commercialization of oxygen consuming electrodes.

There are two traditional methods for operating electrolytic cells employing oxygen consuming cathodes. The first method is to completely immerse the cathode in the caustic liquor, spaced apart from the separator used. Since the solubility of oxygen in caustic is very low, the rate at which oxygen can reach the cathode is low. Further, because of the large amounts of water in the catholyte, the probability of the very undesirable and dangerous reaction evolving hydrogen is high.

In the second traditional method, the oxygen consuming hydrophobic cathode is again spaced away from the separator by caustic liquor which is located between the separator and the cathode. On the back side of the cathode, oxygen, air, or oxygen-enriched air is supplied in a gas filled chamber. The oxygen consuming reaction depends upon oxygen diffusing from the gas side of the cathode and water diffusing from the liquid side of the cathode under very exact hydrostatic conditions. The hydrophobic cathode does not permit liquid flow therethrough. For the complicated reactions to occur properly, the hydrostatic pressure and the gas pressure need to be in balance, and as the hydrostatic pressure is not constant over the surface of the electrode, the pore sizes of the cathode need to vary accordingly. This balancing problem is a real constraint on the structure of the electrodes and the operating efficiency of the cells.

Coker et al in U.S. Pat. No. 4,191,618, issued Mar. 4, 1980 describes a membrane cell having the electrodes bonded to the surface of the membrane. An oxygen containing gas is passed through the catholyte to prevent or limit the discharge of hydrogen at the cathode. The cell was operated at various current densities to produce very dilute NaOH solutions at low current efficiencies.

More recently, oxygen-consuming cathodes have been employed which permit some flow of liquid through the cathode. U.S. Pat. No. 4,376,691, issued Mar. 15, 1983 to O. Lindstrom, teaches an oxygen-consuming cathode having a hydrophobic side in which holes can be made in up to about 10% of the surface area to permit the electrolyte to flow through the cathode.

In U.S. Pat. No. 4,332,662, issued Jun. 1, 1982 to D. Pouli et al, a conventional hydrophobic cathode having a catalyst bonded with polytetrafluoroethylene has openings which provide an open are of 2 to 80% . The openings are holes or regions of greater hydrophilicity which permit the liquid product to flow through. Both of these patents teach cells that require hydrophobic cathodes which are subsequently modified and the cells of these patents are operated at low current densities.

There is a need, therefore, for an electrolytic cell using oxygen-consuming cathodes whose operation overcomes the difficulties and disadvantages of the methods of the prior art.

It is an object of the present invention to provide a process for operating an electrolytic cell which is independent of oxygen gas and liquid diffusion rates.

Another object of the present invention is to provide a process for operating an oxygen-consuming electrolytic cell in which the hydrostatic pressure is minimized over the entire cathode area.

An additional object of the present invention is to provide a process for operating an oxygen-consuming electrolytic cell which produces concentrated solutions of alkali metal hydroxides.

A further object of the present invention is to provide a process for operating electrolytic cells using oxygen-consuming cathodes which results in low voltages while employing high current densities.

Yet another object of the present invention is to provide a process for operating oxygen-containing electrolytic cells at increased current densities while preventing the formation of hydrogen gas.

A still further object of the present invention is to provide a process for operating electrolytic cells using oxygen-consuming cathodes in the absence of a substantial accumulation of catholyte liquor in the cathode compartment.

These and other objects of the present invention are accomplished in a process for the electrolysis of an alkali metal halide brine in an electrolytic cell having an anode compartment containing at least one anode, a cathode compartment containing at least one hydrophilic porous cathode, and a cation exchange membrane separating the anode compartment from the cathode compartment, the hydrophilic porous cathode being in contact with the process cation exchange membrane, the process which comprises:

(a) feeding the alkali metal halide brine to the anode compartment;

(b) electrolyzing the alkali metal halide brine at a current density of at least about 2 kiloamperes per square meter to produce a halogen gas and alkali metal ions in the anode compartment;

(c) passing the alkali metal ions and water through the cation exchange membrane into the cathode compartment;

(d) feeding an oxygen-containing gas to the cathode compartment;

(e) producing a concentrated alkali metal hydroxide solution while limiting the formation of hydrogen; and (f) removing the concentrated alkali metal hydroxide solution from the cathode compartment to prevent an accumulation of concentrated alkali metal hydroxide in the cathode compartment.

BRIEF DESCRIPTION OF THE DRAWING

The figure is a graph plotting the cell voltage in volts against the current density in $KA/m^2$. The horizontal line labelled "Onset of $H_2$" indicates the cell voltage at which hydrogen formation begins.

The novel process of the present invention electrolyzes alkali metal halide brines which are aqueous solutions of alkali metal halide such as alkali metal chlorides or alkali metal bromides. The process operates over a wide range of current densities while preventing the formation of hydrogen gas in amounts which might produce an explosive mixture with the oxygen gas present. Alkali metal chloride brines such as sodium chloride, potassium chloride or alkali metal bromide brines such as sodium bromide when electrolyzed produce chlorine or bromine and a concentrated alkali metal hydroxide solution. For example, when sodium chloride brines are electrolyzed, the NaCl concentration is from about 150 to about 300 grams per liter; and preferably from about 170 to 220 grams per liter; and the sodium hydroxide solution produced contains at least 25 percent, and preferably from about 35 to about 50 percent by weight of NaOH. To produce these concentrated alkali metal hydroxide solutions efficiently and economically, the novel process of the present invention can be operated at current densities of at least about 2, for example from about 2 to about 10 kiloamperes per square meter of membrane surface. Preferred current densities are those in the range of from about 2.5 to about 8 kiloamperes per square meter, with the more preferred range being from about 3 to about 5 kiloamperes per square meter. For example, at the operating current densities the cell voltage is controlled to prevent the formation of significant amounts of hydrogen.

One means of regulating the cell voltage is through the use of a control circuit for the direct current rectifier. This control circuit provides an upper limit to the voltage output of the rectifier and acts to reduce the output current should the voltage demanded by the load, in this case a cell, reach the set limit. In this way, the output voltage will not exceed the pre-set limit. If the voltage demand from the load decreases, the control circuit increases the output current.

In another embodiment, the cell voltage is monitored by means such as a device or electrical circuit separate from the rectifier control. This monitoring means can sound an alarm to alert the operator, or to activate an emergency shutdown process if a predetermined voltage limit is reached.

During cell operation, the anode compartment and the cathode compartment are maintained at substantially the same temperatures, for example, temperatures in the range of from about 60° to about 95° C.

In the anode compartment, halogen gases such as chlorine or bromide are produced as well as alkali metal cations such as sodium or potassium. During cell operation, the alkali metal cations and water are transported from the anode compartment through the cation exchange membrane to the cathode compartment.

The production of the concentrated alkali metal hydroxide solution (catholyte liquor) in the cathode compartment is the result of the combination of hydroxide ions, formed by decomposition of the water which is transported through the membrane or added to the cathode compartment, with the alkali metal ions. By maintaining the cation exchange membrane in contact with the hydrophilic cathode, the alkali metal hydroxide solution continuously flows freely through the cathode to prevent a buildup of alkali metal hydroxide solution between the membrane and the cathode. The concentrated alkali metal hydroxide product is accumulated in the cathode compartment and recovered from the cell by known procedures. In a preferred embodiment, the immediate and continuous removal of the catholyte liquor as it is produced enables the cell to be operated substantially catholyteless and without the cathode or the membrane on the cathode side being immersed in a substantial body of catholyte liquor. This continual draining of the alkali metal hydroxide solution permits the cell to be operated to produce maximum concentrations of alkali metal hydroxide for the cation exchange membrane and the current density employed.

Since the cell is operated in a nearly catholyteless condition, the interior volume of the cell is filled with substantially all gas and little liquid. The composition of this gas will depend on which one of two modes of operation are utilized.

In the first mode, the closed mode, pure oxygen is fed to the cell at approximately the same rate at which the oxygen is consumed at the cathode surface. The gas, which normally remains in the cathode chamber, consists of oxygen and water vapor. When operating in this closed mode, the cell voltage is maintained below or at about the reversible potential for hydrogen generation to substantially prevent the formation of hydrogen. When operating in the closed mode, even at a very small rate of formation, the hydrogen concentration in the cathode chamber gas would slowly increase and eventually the hydrogen/oxygen ratio would pass the limit for safe operation. When producing chlorine from an alkali metal chloride brine, the cell voltage in the closed mode of operation is thus maintained at a maximum of about 2.3 volts and the controlled amount of hydrogen is less than about 4 percent by volume of the oxygen-containing gas.

In the second mode of operation, the purge mode, the gas flow to the cathode chamber is increased to the extent that some gas is purged from the cell. This would mean that some small amount of hydrogen evolution could be tolerated since a portion of the hydrogen gas is removed from the cell. The hydrogen concentration, however, is maintained below the limit for safe operation. Also, the gas fed to the cell in the purge mode of operation need not be pure oxygen, but can be air or oxygen-enriched air. It is, however, necessary to ensure that the volume of oxygen delivered to the cathode chamber is equal to or greater than the volume required to sustain the oxygen reduction reaction at the cathode.

In whichever mode the cell is operated, the gas in the cathode chamber can be sampled and analyzed by standard analytical techniques such as gas chromatography. The presence of hydrogen can be readily detected among the other gases should it occur.

The amount of catholyte liquor present in the cathode compartment during operation of the cell is less than about 30 percent by volume. Preferably, the level of concentrated alkali metal hydroxide in the cell during operation is maintained below the active electrode area of the cathode; that is the area of the cathode at which electrolysis takes place. The cathode is, therefore, exposed to a gaseous atmosphere over at least 70 percent, preferably 80 to 100 percent, and more preferably 90 to 100 percent of its active electrode area; that is, not more than 30 percent of the active electrode area is immersed in the concentrated catholyte liquor.

During the operation of the cell, the addition of water or a caustic solution to the cathode compartment generally is not required, and preferably, the only water added to the cathode compartment is that which is transferred through the membrane. To prevent damage such as blistering to the membrane during the cell start-up period, it may be necessary to condition the membranes. This can be accomplished by one of several methods. For example, the cathode chamber can initially be filled with an alkali metal hydroxide solution to wet the cathode, the cathode-membrane contact area, and the cathode side of the membrane, while flushing gases such as nitrogen from the compartment. The catholyte is then drained from the cathode compartment and simultaneously an oxygen containing gas is fed to fill the cathode compartment. In another embodiment, during the initial start-up period, the cell may be operated at low current densities, for example, those below about 1 kiloampere per square meter. During the start-up period, the current density is gradually increased until the cell is operating at a current density of at least about 2 kiloamperes per square meter. In this way,the overall membrane and membrane-cathode interface is gradually exposed to alkali metal hydroxide solution.

In a preferred embodiment where the only source of liquid to the cathode compartment is by transfer through the cation exchange membrane, the concentration of the catholyte liquor produced is directly related to the rate at which water is transported through the membrane during cell operations. In membrane cells, this rate is known as the water transport number. Suitable membranes employed in the novel process of the present invention have water transport numbers (WTN) in the range of from about 2 to about 7. These water transport numbers are related to the desired concentration of the alkali metal hydroxide solution and the current efficiencies achieved. For example, where a solution of sodium hydroxide containing 50% or greater by weight of NaOH is being produced, a membrane having a water transport number of at least 2, for example, from about 2.3 to about 2.6 is required at operating current efficiencies in the range of about 80% to about 95%. Similarly, at membrane water transport numbers in the range of from about 5.8 to about 6.8, a sodium hydroxide solution containing about 25% by weight of NaOH is produced.

Cation exchange membranes, which can be employed as the separator in the process of the present invention, are inert, flexible membranes, which are substantially impervious to the hydrodynamic flow of the electrolyte and the passage of gas products produced in the cell. Suitably used, for example, are those comprised of fluorocarbon polymers having a plurality of pendant sulfonic acid groups, carboxylic acid groups, or mixtures of sulfonic acid groups and carboxylic acid groups. The terms "sulfonic acid group" and "carboxylic acid group" are meant to include salts of sulfonic acid or salts of carboxylic acid which are suitably converted to or from the acid groups by processes such as hydrolysis. Suitable cation exchange membranes are produced by Dow Chemical Co.; and sold commercially by E. I. DuPont de Nemours and Company under the trademark "Nafion"; by the Asahi Glass Company under the trademark "Flemion"; and by the Asahi Chemical Co. under the trademark "Aciplex".

The cation exchange membrane may be positioned, for example, vertically or horizontally to separate the anode compartment from the cathode compartment. The cathode is placed in contact with the membrane, and the anode may also be placed in contact with the membrane, if desired, to reduce power consumption.

Suitable hydrophilic cathodes employed in the electrolytic cell of the present invention include those having at least one catalytically active material including, for example, porous materials such as those of a Raney metal (e.g. silver), porous graphite, platinum or a platinum group metal, or permeable catalytic electrodes such as those having cathode catalyst materials attached to or embedded in the membrane. The cathodes which can be employed permit the flow of water through the cathode, for example, at a rate of at least 5 milligrams per square centimeter per minute, and preferably at from about 10 to about 20 milligrams per square centimeter per minute. This rate is determined by collecting, for a given period of time, the alkali metal hydroxide product and determining the product weight and its concentration of alkali metal hydroxide in percent by weight. The weight of alkali metal hydroxide is calculated and subtracted from the total product weight. The weight of water obtained is then divided by the collection time.

One preferred cathode embodiment comprises an air (or oxygen) depolarized cathode which is hydrophilic and stable in concentrated alkali metal hydroxide solutions. The cathode has a low load of platinum or a platinum group metal and may include, for example, as an electrode support a conductive metal screen such as that of nickel or cobalt which may have deposited thereon a matrix of a conductive material such as graphite having a catalyst such as silver or a platinum group metal embedded therein.

Other suitable cathodes include highly porous reticulate cathodes comprised of electroconductive filaments and having a means of applying an electrical potential to the filaments. The filaments may be those of the electroconductive metals themselves, for example, nickel, titanium, platinum, or steel, or of materials which can be coated with an electroconductive metal. Materials which can be coated with these electroconductive metals include, for example, metals such as silver, titanium, or copper; plastics such as polyarylene sulfides, polyolefins produced from olefins having 2 to about 6 carbon atoms and their chloro- and fluoro- derivatives, nylon, melamine resins, acrylonitrile-butadiene-styrene (ABS) copolymers, and mixtures thereof.

Where the filaments are nonconductive to electricity, it may be necessary to sensitize the filaments by applying a metal such as silver, nickel, aluminum, palladium or their alloys by known procedures. The electroconductive metals are then deposited on the sensitized filaments.

Suitable reticulate electrodes and methods for their fabrication are described in U.S. Pat. No. 4,370,214, issued Jan. 25, 1983, to I. V. Kadija which is incorporated herein in its entirety by reference.

Hydrophilic cathodes employed in the process of the present invention permit liquid flow through the cathode over the entire active electrode area. This free flow of liquid through the cathode substantially prevents the buildup of hydrostatic pressure across the cathode.

The oxygen-containing gas supplied to the cathode compartment may be oxygen, air, and mixtures thereof. When a gas containing air is used, it is advisable to remove $CO_2$ contained therein, by known means such as scrubbing in a caustic solution, prior to feeding the gas to the cathode compartment.

Any commercially available anodes for use in, for example, chlor-alkali electrolytic cells may be employed in the electrolytic cell and process of the present invention. These include anodes of graphite or a foraminous valve metal such as titanium or tantalum having an electrochemically active coating over at least a portion of the anode surface. Suitable coatings include those of a platinum group metal, platinum group metal oxide, an alloy of a platinum group metal or mixtures thereof. The term "platinum group metal" means an element of the group consisting of ruthenium, rhodium, platinum, palladium, osmium and irridium. Coatings containing mixtures of valve metal oxides such as titanium oxide and platinum group metal oxides such as ruthenium oxide are described in U.S. Pat. No. 3,632,498 issued to H. B. Beer on Jan. 4, 1972. Other anodes which may be employed include those described in U.S. Pat. Nos. 4,333,805, issued Jun. 8, 1982, to C. R. Davidson et al; 4,240,887, issued Dec. 23, 1980, to D. E. Hall; 4,200,515, issued Apr. 29, 1980, to D. E. Hall et al; 4,042,484, issued Aug. 16, 1977, to G. Thiele et al; 3,962,068, issued Jun. 8, 1976, to D. Zoellner et al; and 3,992,280, issued Nov. 16, 1976, to D. Zoellner et al.

By employing the novel electrolytic cell of the present invention, it is possible to reduce the cell voltage substantially; to reduce the volume of the cathode compartment; eliminate liquid addition to the cathode compartment; eliminate catholyte gas disengaging means; and eliminate recirculation means such as downcomers and upcomers from the cathode compartment. These reductions and eliminations substantially reduce the material and capital costs of an electrolytic membrane cell while permitting an increase in productivity per unit area of floor space.

Where a limited production of chlorine and alkali metal hydroxide are desired at a users plant site, additional advantages include the direct use of chlorine gas without liquefaction, and the direct use of the alkali metal hydroxide solution produced without concentration by evaporation which results in a substantial reduction of processing and shipping costs.

Operation of the process of the present invention is free of the restrictions for hydrostatic pressures and gas pressures required when hydrophobic cathode materials are used in the cathode compartment. The process further permits the use of increased current densities without forming significant amounts of hydrogen gas.

The novel electrolytic process of the present invention produces catholyte liquor which is at a high concentration for the membranes selected. For example, where the catholyte liquor is sodium hydroxide, the catholyte concentration is at least about 25 percent, and preferably from about 30 to about 50 percent by weight of NaOH.

The novel process of the present invention is illustrated by the following EXAMPLES without any intention of being limited thereby.

EXAMPLE 1

An electrolytic cell having an ACIPLEX® F(532) cation exchange membrane (WTN=4.0) vertically separating the anode compartment from the cathode compartment was constructed. The cell employed as the anode a porous titanium mesh having a mixture of ruthenium oxide and titanium oxide as the electrochemically active coating. The anode was spaced apart from the cathode. An electrolyte porous hydrophilic low platinum loaded (0.50 mg/cm$^2$±10%) air cathode was employed as the cathode. The cathode was placed in contact with the membrane. Sodium chloride brine was continuously fed to the anode compartment to provide an anolyte having a NaCl concentration of 196 grams per liter with the depleted anolyte being continuously removed from the anode compartment. Prior to cell startup, the cathode compartment was filled with 35% NaOH. The caustic solution was drained from the cathode compartment and oxygen gas continuously fed into the cathode compartment. Electric current at a current density of 3 kiloamps per square meter was passed through the cell and chlorine gas was produced at the anode. The NaOH solution produced, at an average concentration of 33.8 percent, was removed from the bottom of the cathode compartment at a rate which prevented an accumulation of caustic product in the cathode compartment. The rate of water which flowed through the cathode was determined to be 13 milligrams per square centimeter per minute. The cell was operated in the closed mode for a period of 10 days at an average cell voltage of 2.16 volts, a current efficiency of 94.9% and a power consumption of 1525 kilowatt hours per metric ton of NaOH.

EXAMPLE 2

An electrolytic cell was constructed having as the cation exchange membrane ACIPLEX® F(582) (WTN=4.2) positioned horizontally in the cell. The anode and cathode employed were identical to those used in EXAMPLE 1 and both contacted the cation exchange membrane. Sodium chloride brine was fed to and removed from the anode compartment to maintain the anolyte concentration at 208 grams per liter of NaCl. Current was passed at a current density of 3.0 kA/m$^2$ to continuously produce chlorine gas and an alkali metal hydroxide solution having an average concentration 35.9% by weight of NaOH. During the 2 days of cell operation, the cell voltage averaged 2.07 volts with the current efficiency averaging 94.0%, and a power consumption of 1476 kilowatt hours per metric ton of NaOH.

EXAMPLE 3

An electrolytic cell was constructed which was identical to that used in EXAMPLE 1. The cell was operated in the closed mode as in EXAMPLE 1 except that the current was changed every few minutes and a record was made of the cell voltage at each current. These points appear as curve A in the Figure. The voltage at 3.0 kA/m$^2$ was 2.21V.

EXAMPLE 4

An electrolytic cell was constructed having as the cation exchange membrane ACIPLEX® F(582) (WTN=4.2) positioned horizontally in the cell. The anode and cathode employed were identical to those used in EXAMPLE 1 and both contacted the cation exchange membrane. Sodium chloride brine (280 gpl NaCl) was fed to and removed from the anode compartment to maintain the anolyte concentration at 180 grams per liter of NaCl. The cell voltage was maintained below a value of 2.30V by the use of special control circuitry in the direct current rectifier that operated the cell. This circuitry allowed a voltage limit to be set in the rectifier control. The cell was operated using constant current which allowed the rectifier to supply the voltage necessary to maintain the current density. When the voltage required by the cell reached the limiting voltage, the control circuit "crossed-over" to constant voltage and the current was decreased. After two weeks of operation at 3.0 kA/m$^2$, the voltage limit was removed and the current was increased to 7.6 kA/m$^2$ for two hours. During this period the cell voltage increased to 2.60V, which results in the onset of hydrogen production. This data appears as curve B in the Figure. The oxygen feed rate was increased to match the higher operating rate and then increased even more to provide a gas flow from the cell large enough to purge a gas sampling tube. Gas captured in the tube was analyzed by gas chromatograph and found to contain 2 percent hydrogen. The cell was operated for a total of 32 days at 3.0 kA/m$^2$ at an average voltage of 2.11V and a current efficiency of 96.7%.

What is claimed is:

1. A process for the electrolysis of an alkali metal halide brine in an electrolytic cell having an anode compartment containing at least one anode, a cathode compartment containing at least one hydrophilic porous cathode, and a cation exchange membrane separating the anode compartment from the cathode compartment, the process which comprises:

(a) feeding the alkali metal halide brine to the anode compartment;

(b) electrolyzing the alkali metal halide brine at a current density of at least about 2 kiloamperes per square meter to produce a halogen gas and alkali metal ions in the anode compartment;

(c) passing the alkali metal ions and water through the cation exchange membrane into the cathode compartment wherein contact is maintained between the cation exchange membrane and the hydrophilic porous cathode;

(d) passing the alkali metal ions and water through the hydrophilic porous cathode;

(e) feeding an oxygen-containing gas to the hydrophilic porous cathode in the cathode compartment;

(f) producing a concentrated alkali metal hydroxide solution;

(g) regulating the cell voltage to limit the formation of hydrogen; and (h) removing the concentrated alkali metal hydroxide solution from the cathode compartment to prevent an accumulation of concentrated alkali metal hydroxide in the cathode compartment.

2. The process of claim 1 in which said alkali metal halide is an alkali metal chloride or an alkali metal bromide.

3. The process of claim 2 in which an electrolytic cell voltage is regulated by control circuiting of a direct current rectifier.

4. The process of claim 3 in which the electrolytic cell is operated in a closed mode.

5. The process of claim 4 in which the alkali metal brine is sodium chloride and the cell voltage is maintained at a maximum of about 2.3 volts.

6. The process of claim 5 in which the oxygen-containing gas is oxygen.

7. The process of claim 6 in which the cation exchange membrane is positioned horizontally in the electrolytic cell.

8. The process of claim 6 in which the current density is from about 2.5 to about 8.

9. The process of claim 8 in which the water flows through the hydrophilic porous cathode at a rate of at least 5 milligrams per square centimeter per minute.

10. The process of claim 8 in which the cation exchange membrane is positioned vertically in the electrolytic cell.

11. The process of claim 10 in which the current density is from about 3 to about 5.

12. The process of claim 11 in which the concentrated alkali metal hydroxide solution is maintained at a level below active electrode areas of the hydrophilic porous cathode.

13. The process of claim 12 in which the concentrated alkali metal hydroxide is a solution of sodium hydroxide containing at least 25 percent by weight of NaOH.

14. The process of claim 3 in which the electrolytic cell is operated in the purge mode.

15. The process of claim 14 in which the amount of hydrogen formed is less than about 4 percent by volume of the oxygen-containing gas.

16. The process of claim 15 in which the oxygen-containing gas is selected from the group consisting of oxygen, air, and oxygen-enriched air.

17. The process of claim 16 in which the concentrated alkali metal hydroxide solution is maintained at a level below active electrode areas of said hydrophilic porous cathode.

18. The process of claim 17 in which the concentrated alkali metal hydroxide is a solution of sodium hydroxide containing at least 25 percent by weight of NaOH.

* * * * *